US010011331B2

(12) United States Patent
Connolly

(10) Patent No.: US 10,011,331 B2
(45) **Date of Patent: *Jul. 3, 2018**

(54) FLOTATION DEVICE

(71) Applicant: Mark Connolly, Santa Barbara, CA (US)

(72) Inventor: Mark Connolly, Santa Barbara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/422,814

(22) Filed: Feb. 2, 2017

(65) Prior Publication Data

US 2017/0267320 A1 Sep. 21, 2017

Related U.S. Application Data

(63) Continuation of application No. 14/339,851, filed on Jul. 24, 2014, now Pat. No. 9,598,153.

(51) Int. Cl.

| | |
|---|---|
| ***B63B 35/73*** | (2006.01) |
| ***A63B 31/10*** | (2006.01) |
| ***A63B 31/00*** | (2006.01) |
| ***A63B 21/008*** | (2006.01) |
| *A63B 22/00* | (2006.01) |

(52) U.S. Cl.

CPC ..... *B63B 35/73* (2013.01); *A63B 21/0084* (2013.01); *A63B 31/00* (2013.01); *A63B 31/10* (2013.01); *A63B 2022/0094* (2013.01)

(58) Field of Classification Search

CPC ..... B63B 35/73
USPC ..... 441/131
See application file for complete search history.

(56) References Cited

U.S. PATENT DOCUMENTS

| | | | | |
|---|---|---|---|---|
| 1,758,289 | A | 5/1930 | Loy | |
| 2,956,616 | A * | 10/1960 | Labusky et al. | A47D 13/04 280/87.051 |
| 3,042,945 | A | 7/1962 | Saeman | |
| 4,358,866 | A * | 11/1982 | Rhodes | A47C 15/006 114/363 |
| 4,768,774 | A * | 9/1988 | Beasley | A63B 21/0084 441/129 |
| 4,861,300 | A | 8/1989 | Casagrande et al. | |
| 4,885,810 | A | 12/1989 | Unger et al. | |

(Continued)

FOREIGN PATENT DOCUMENTS

| | | |
|---|---|---|
| DE | 19733805 A1 | 2/1999 |
| FR | 2787775 A3 | 3/2001 |

(Continued)

OTHER PUBLICATIONS

European Search Report, application No. 15178371.9, dated Jan. 13, 2016.

*Primary Examiner* — S. Joseph Morano
*Assistant Examiner* — Jovon Hayes
(74) *Attorney, Agent, or Firm* — Carlos A. Fisher

(57) ABSTRACT

The present application is directed to a flotation device for use in aquatic physical therapy. The flotation device preferably comprises side portions that wholly or partly surround the user, and permit the user's elbow(s) and/or forearms to rest upon and be supported thereby. The flotation device also preferably has at least one handgrip permitting the user to easily hold onto and be supported by the flotation device. Additionally, the present invention comprises methods of making and using such a flotation device.

20 Claims, 2 Drawing Sheets

(56) References Cited

U.S. PATENT DOCUMENTS

D350,380 S * 9/1994 Rothhammer ..... A63B 1/10 D21/803
5,385,521 A * 1/1995 Weissbuch ..... A63B 31/10 434/254
5,597,277 A * 1/1997 Mayfield ..... B63B 35/74 114/344
5,628,658 A 5/1997 Clifford
5,667,416 A * 9/1997 Barth ..... A47C 15/006 441/130
5,833,505 A * 11/1998 Huang ..... A63B 69/14 441/117
6,056,613 A 5/2000 Pike
6,142,843 A * 11/2000 Haase ..... A63B 21/0084 441/129
6,155,899 A 12/2000 Boddy
6,276,979 B1 8/2001 Saltel et al.
6,749,475 B2 * 6/2004 Howerton ..... A47C 15/006 114/345
6,929,521 B2 * 8/2005 Howerton ..... A47C 15/006 114/345
7,207,857 B2 4/2007 Zheng
7,322,868 B2 * 1/2008 Ross ..... B63B 35/78 441/130
7,484,961 B2 2/2009 Blaski et al.
7,648,449 B1 * 1/2010 Detert ..... A47C 27/081 441/129
7,658,696 B2 * 2/2010 Hunter ..... A61H 1/0237 482/10
7,955,226 B2 * 6/2011 Dauben ..... A63B 31/00 441/129
8,292,683 B2 * 10/2012 Axtell ..... B63B 35/73 114/351
2003/0166366 A1 * 9/2003 Kemp ..... B63B 3/13 441/129
2011/0092116 A1 * 4/2011 Ruiz ..... B63B 35/73 441/73
2012/0164899 A1 * 6/2012 Pope ..... B63B 35/73 441/129

FOREIGN PATENT DOCUMENTS

FR 2883766 A1 10/2006
WO 2007019635 A1 2/2007

* cited by examiner

FLOTATION DEVICE

RELATED APPLICATIONS

This application is a continuation of U.S. patent application Ser. No. 14/339,851, filed Jul. 24, 2014, which is hereby incorporated herein by reference in its entirety.

FIELD OF THE INVENTION

The present invention is related to the medical, physical therapy and physical rehabilitation fields. The invention is directed to apparatus and methods for assisting patients having ambulatory and motor disorders to regain motor abilities. Preferably the apparatus includes a flotation device for use in aquatic or pool therapy sessions. The flotation device may be particularly adapted for use by persons experiencing limited motor abilities to be able to exercise and articulate their legs and muscles safely in a pool, while remaining afloat.

BACKGROUND

Persons who suffer a traumatic injury to their legs, back, or spine, for example, and accident or a stroke or other neurological event) commonly experience a loss or paralysis of motor abilities as an immediate result of the trauma. In all cases of neurological injury, particularly (although not exclusively) in the case of a stroke, the patient generally begins rehabilitation as soon as possible (even 24 to 48 ours after the event, if possible). A recent study at the U.S. National Institute of Neurological Disorders and Stroke, has indicated that patients may continue to regain motor function over one year after a stroke or accident giving rise to the deficit.

Rehabilitation helps stroke survivors relearn skills that are lost when part of the brain is damaged. For example, these skills can include coordinating leg movements in order to walk or carrying out the steps involved in any complex activity. Rehabilitation also teaches survivors new ways of performing tasks to circumvent or compensate for any residual disabilities.

Water has rehabilitating qualities; stroke survivors and other patients who are hampered with limitations such as loss of muscular strength often find that water therapy can significantly enhance their recovery and can offer a better quality of life. In addition to stroke survivors, other patients that may benefit from aquatic therapy may include, without limitation, those suffering from arthritis or joint pain, musculoskeletal disorders, chronic back pain, foot, ankle or knee pain, spinal cord injuries, amputation, or brain injury.

In water, body weight is decreased by up to 90 percent; buoyancy makes moving easier. Water, being denser than air, helps supports the body, improving a person's balance and coordination. This support allows a person to gain confidence in movement abilities. People have greater flexibility in water, allowing them to exercise and stretch their muscles in ways that are not possible on land, with much less risk of falling while doing so.

Since people tend to be more stable in water than in air, it is possible to gain more strength in less time in water than it is on land due to water's density and resistance. Resistance increases blood flow, which in turn increases a person's ability to regain muscle and motor performance. Water therapy is an extremely gentle form of exercise that is one of the most effective ways to build strength and improve cardiovascular capabilities. A stronger body can mean more competence in performing daily activities on land.

However, not all patients having neurological or motor deficits in their lower extremities or trunk are sufficiently stable to maintain balance in water, particularly as they begin hydrotherapy. Such patients may have need of a flotation support in water.

Floatation collars, "water wings" worn on the arms, small kickboards, and buoyancy vests have been used as floatation devices for hydrotherapy.

Howerton, U.S. Pat. No. 6,749,475 and U.S. Pat. No. 6,929,521 discusses a "personal watercraft" comprising a U-shaped inflatable float tube having a stabilizing frame and a seating device bridging two leg portions of the floatation chamber. The device is said to be useful as a "floating chair", for example for fishermen or hunters, and may be enhanced with additional apparatus between the leg portions such as a shelf for placing a tackle box, or a tray for a beverage holder.

Ross, U.S. Pat. No. 7,322,868 discusses water devices comprising a main part and a supporting part releasably connected thereto. The supporting part comprises a piece of material located between elongate portions of the main part to be used, for example to support the trunk, thus permitting the user to place or submerge the face in the water, or to lie on his or her back, if desired.

Unger et al., U.S. Pat. No. 4,885,810 is drawn to an articulated litter for assisting hydrotherapy patients in getting into and out of water.

Weissbuch, U.S. Pat. No. 5,385,521, is drawn to an aquatic exercise device said to serve dual functions as a hand-held kickboard and a buoyancy device worn around the midsection.

However, there remains a need in the art for flotation devices that are tailored for patients having motor deficits or disorders, permitting them to have a buoyancy aid to walk and/or exercise in water, while also preferably having, for example, one or more handgrips to assist the patient to maneuver and manipulate the device.

SUMMARY OF THE INVENTION

The present invention is directed to flotation devices for to stabilize patients undergoing rehabilitative aquatic or pool therapy. The buoyancy of the water in the pool gives a patient increased facility to move his or her limbs, regain loss of coordination, and develop muscle strength and tone in a supportive and gently resistive environment. Also warm waters will improve a patient's circulation and salts dissolved in the water may have therapeutic value.

Some patients who are unable to walk or stand due, for example, to neuromuscular disorders or conditions may nevertheless be able to stand and move in water, provided they have some sort of support. While holding onto a support such as another person or a handhold (such as a railing) along the side of a pool may be sufficient support to assess a patient's potential for buoyancy-assisted therapeutic rehabilitative work, ideally a patent would be able to support themselves without the need for another person or help support them. Furthermore, while handrails can be of some assistance in facilitating patients getting in and out of the pool, it is very preferable that the majority of an aquatic rehabilitative session can be done away from the sides of the pool to reduce the potential for injury, for example, by falling against the edge of a pool.

According to specific examples of the invention, the invention comprises a flotation device which may be a substantially flat board having positive buoyancy. The board has a front section and two side sections and is preferably substantially or partially bilaterally symmetrical.

Each and every publication (include internet websites and the like), patent and published patent application cited in this patent application is hereby individually incorporated by reference in its entirety as part of this patent application.

DETAILED DESCRIPTION OF THE INVENTION

Figure 1B:
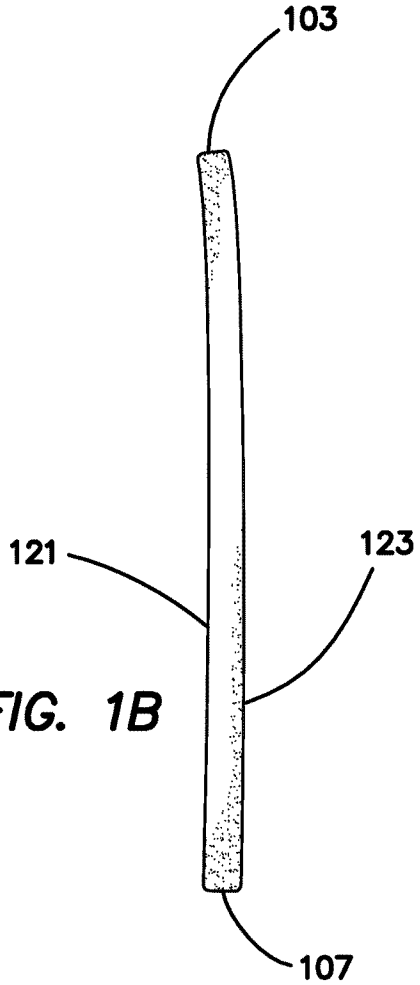
FIG. 1B is a side view of the flotation device of FIG. 1A.
Figure 1A:
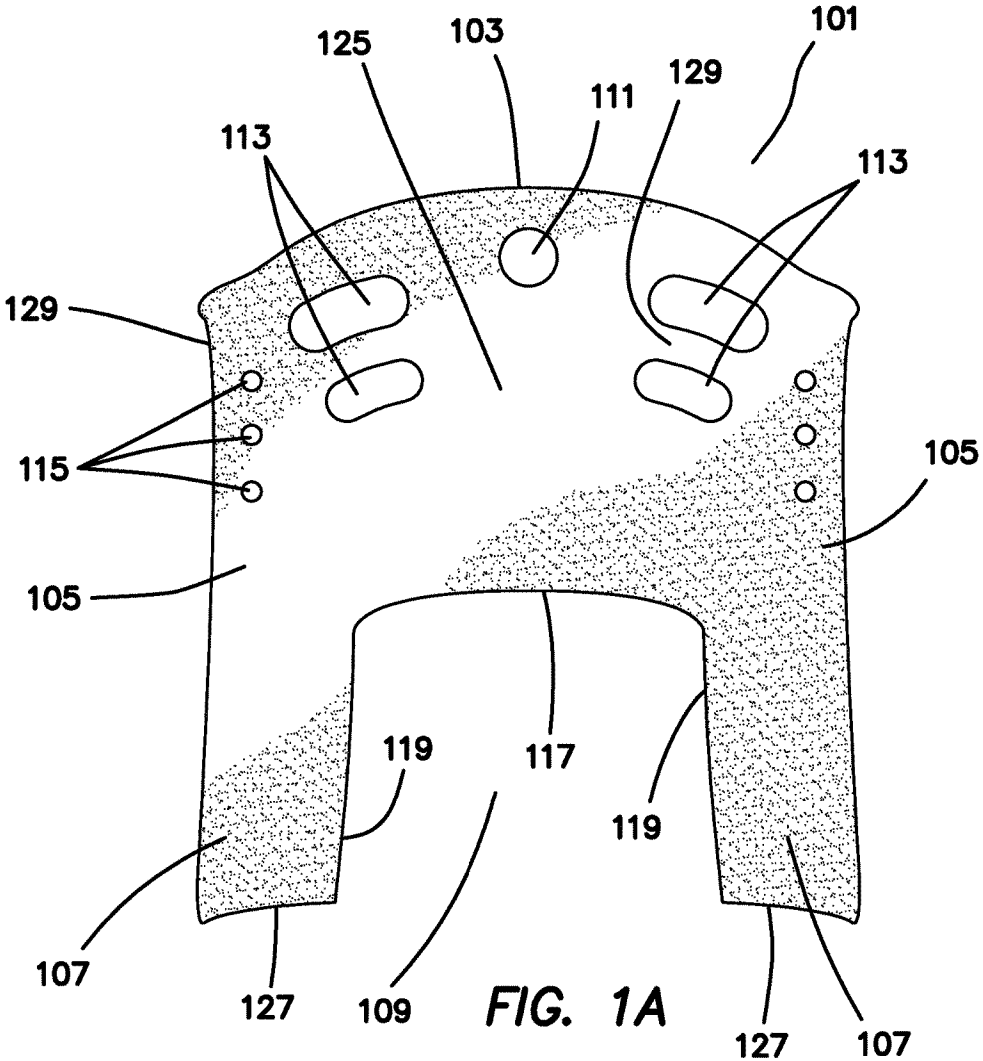
FIG. 1A shows a top view of one example of a flotation device of the present invention.

FIG. 1A is a top view of a preferred example of the flotation device of the present invention. The flotation device 101 of this example is preferably made from a buoyant material, such as a foamed polymer such as foamed polystyrene, polyurethane, polyethylene, polypropylene or a composition containing one or more of these polymers. The foam may be "open cell" or "closed cell"; these terms refer to whether (or the degree to which) bubbles formed during the foaming step in the manufacture of the material are permitted to burst or not. Foamed polymers containing bubbles which are quickly cooled may be termed "closed cell" foam.

A closed cell foam is generally much more resistant to becoming waterlogged than open cell foam. However, if the foam is open cell it may be included as a "core" material within the floatation devices of the present invention and then enclosed within a waterproof or water resistant shell to prevent it from becoming waterlogged. The flotation devices of the present invention may be made in a manner similar to that of buoyant sports devices such as surfboards and boogie boards, which generally have a waterproof shell material that may be, for example, an epoxy-impregnated fiberglass, or a non-foamed polymer coating.

The flotation device of this example can be made from a block of 4 LB density cross-linked polyethylene foam (XLPE foam) by shaping with a water jet cutter. In other embodiments the invention may be made by injection molding or by a combination of methods, such as extrusion, combined with water jet cutting.

In certain examples, the flotation device may comprise wood, such as balsa or another lightweight wood, in addition to or in combination with a foamed polymer and/or shell. In certain examples the floatation device of the present invention may comprise a hollow air space to provide buoyancy.

The size of the flotation device of the present invention may be any convenient size. In preferred examples the forward portion (described below) may have a length of about 1-3 feet, or about 1-2 feet, or about 18 inches, from the forward edge to the rear edge of the forward portion. In preferred examples the forward portion preferably has a width of 1-3 feet, or about 1.5 to about 2.5 feet, or about 2 feet. Each of the side portions preferably have a length of about 1-3 feet, or about 1-2 feet, or about 1.5 to 2 feet and a width of about 6 inches to about 12 inches, or about 8 inches to about 10 inches.

The floatation device of FIG. 1A comprises a forward portion 125 comprising a forward edge 103, two exterior side edges 105 and a rear edge 117. The exterior side edges 105 extend continuously into the two side portions 107. Each side portion comprises an exterior side edge 105, a rear edge 127 and an interior side edge 119 that is continuous with the rear edge 117 of the forward portion. Together, the two interior side edges 127 of the side portions 107 and the rear edge 117 of the forward portion 125 define a void 109 within which the patient may stand and be supported by the two side portions, upon which he or she may place the elbows and/or forearms for support.

The forward portion of the flotation device also contains features that are useful to help the patient in maneuvering and maintaining contact with the flotation device during use. Thus, FIG. 1A shows one or more elongated void 113 (functioning as a handhold) formed within the forward portion of the flotation device. The elongated void(s) may be used for gripping the floating device while transporting it to or from the pool or during use. In a particularly preferred example, as shown in FIG. 1A, each side of the forward portion of the flotation device comprises at least two elongated voids 113 positioned close together so as leave a narrow elongated strip 129 between them. The elongated voids 113 are sized so as to permit the user to place fingers through one of the voids and the thumb through the other void, thus grasping the elongated strip 129 for a secure handhold.

Additionally, FIG. 1A shows that the preferred flotation device comprises one, or preferably a plurality of, peg holes 115. The peg holes 115 are shaped and sized to permit a peg, for example an elongated tapered peg, to fit and be secured within each peg hole.

Figure 2:
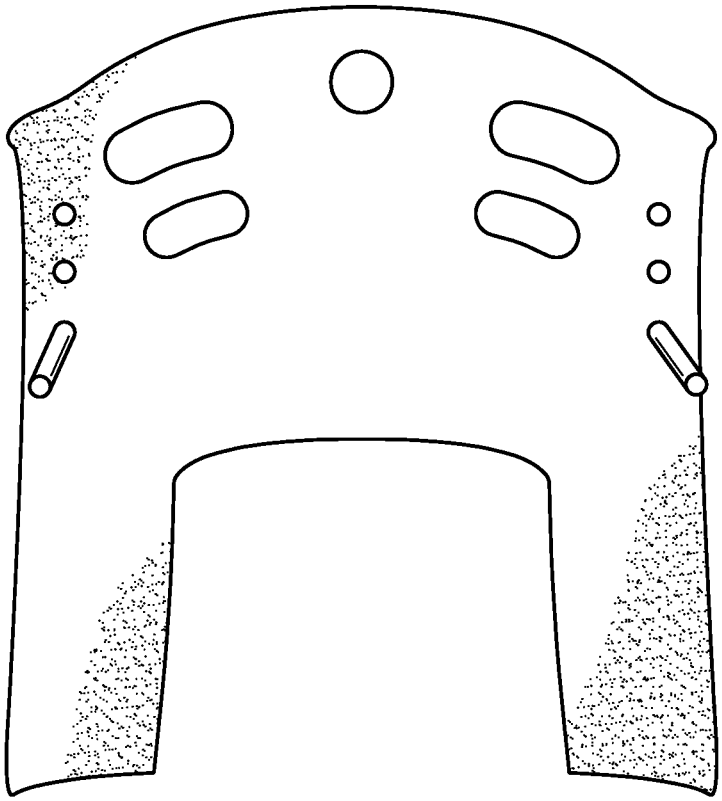
FIG. 2 is a view of an example of a flotation device of the present invention.

In many examples, a peg will be positioned on each side of the flotation device, for example on right and left sides of the forward portion of the flotation device, thereby permitting the user to rest the elbows and/or forearms on the side portions, which grasping the pegs with the hands. The peg holes are positioned to permit the peg(s) to be adjustable to each patient, their abilities, and hand and arm positions. FIG. 2 shows a view of an example of the present invention, in which pegs are placed in right and left peg holes, in each case those peg holes closets to the user standing within the void peg holes.

The flotation device of this example also shows an additional convenient feature: a centrally located circular hole 111 for use as a water bottle or cup holder for rehydration during aquatic therapy. This feature is optional with respect to certain examples of the invention, as is the exact arrangement of handholds. In certain examples the elongated voids 113 may not be present, or may have a different configuration than that shown in FIG. 1A and FIG. 2. In certain examples the elongated voids 113 may have a different configuration that the configuration shown in FIG. 1A and FIG. 2. In certain examples the peg holes 115 may not be present. In some examples the peg holes 115 may have a different configuration that the configuration shown in FIG. 1A and FIG. 2.

It will be understood that the buoyant side portions 107 and the void 109 permitting the patient to stand and be at least partially surrounded by the flotation device of the present invention are important features in many examples of the present invention. These features permit the patient to remain stably supported by the flotation device. It is particularly helpful to those patients lacking significant strength and or movement in their arms that the side portions (and/or rest of the floatation device) remain substantially low with respect to the water level.

It will also be understood that the in some examples, currently less preferred, the flotation device may comprise the side portions 107, the rear edge 117 of the forward portion 125, and a rear portion (not shown) so that the void 109 is not substantially 'U'-, oval- or hemispherical-shaped, but rather is completely surrounded by buoyant sections of the flotation device, thus permitting the patient within to stably stand within the void and place the elbows and/or forearms on the side portions for support.

FIG. 1B is a cross section through the flotation device depicted in FIG. 1A. In this example, it can be seen that the thickness between a top surface 121 and a bottom surface 123 of the buoyant material from which the flotation device is made is relatively constant along the entire length of the flotation device. In some variations of the present invention the flotation device may have thicker areas of the buoyant material or fins. However in a preferred aspect of the invention the foamed polymeric buoyant material is of relatively constant thickness throughout.

In one example the thickness of the buoyant material may be about 1 inch, or about 1.5 inches, or about 2 inches, or about 2.5 inches or about 3 inches or more. Preferably the thickness of the flotation device in each of the two side portions is such that a patient will not need to raise the arms more than a few inches above the surface of the water to permit the forearms to rest on the side portions and be supported thereon. For example, unless expressly indicated otherwise, the thickness of each side portion of the flotation device has a thickness selected from the group of up to about 1 inch, or up to about 1.5 inches, or up to about 2 inches, or up to about 2.5 inches, or up to about 3 inches, or up to about 3.5 inches, or up to about 4 inches. In other example, currently not preferred, the thickness of the floatation device may be greater than about 4 inches.

Also visible in FIG. 1B is a slight upward curving of the material along the forward edge 103 of the forward portion 125 of the flotation device. This upward curving tends to prevent the forward edge of the flotation device from being directed downward when a patient walks in a forward direction. This feature may not be present in all example of the present invention, but is present in some preferred examples.

FIG. 2 is another view of a preferred example of the flotation device of the present invention.

Although aspects of the present invention have been described with reference to the disclosed embodiments, one skilled in the art will readily appreciate that the specific examples disclosed are only illustrative of these aspects and in no way limit the present invention. Various modifications can be made without departing from the spirit of the present invention. Each and every feature described herein, and each and every combination of two or more of such features, is included within the scope of the present invention provided that the features included in such a combination are not mutually inconsistent. Furthermore, any composition or apparatus of the invention will be understood to comprise, consist essentially of, or consist of one or more element of the claim, and additionally, each and every element not specifically included as an element of a claim shall be considered to have basis herein to be specifically excluded in a negative limitation from that claim.

Any and all patents, publications, patent applications, and nucleotide and/or amino acid sequences referred to by accession numbers cited in this specification are hereby incorporated by reference as part of this specification in its entirety.

I claim:

1. A flotation device comprising a substantially flat buoyant component, said substantially flat buoyant component comprising two side portions having a length and width sufficient for a user to rest the elbow or forearm and continuous with a forward portion of the flotation device to define a void sufficiently large to define to permit a person's body to be positioned therewithin, wherein the substantially flat buoyant component comprises a substantially homogenous buoyant material and the flotation device optionally comprises a handhold component selected from the group consisting of: one or more elongated void formed within the flotation device, and one or more peg holes formed within the forward portion of the flotation device.

2. The flotation device of claim 1 comprising a handhold component comprising one or more elongated void formed within the forward portion of the flotation device.

3. The flotation device of claim 2 wherein the handhold component comprises at least two elongated voids positioned proximal each other thereby forming an elongated strip between them.

4. The flotation device of claim 3 wherein the handhold component comprises a left handhold component comprising at least two elongated voids positioned proximal each other on a left side of the forward portion of the flotation device and a right handhold component comprising at least two elongated voids positioned proximal each other on a left side of the forward portion of the flotation device.

5. The flotation device of claim 4 wherein said left handhold component and said right handhold component are arranged with bilateral symmetry on the forward portion of the device.

6. The flotation device of claim 1 comprising a handhold component comprising one or more peg holes formed within the forward portion of the flotation device.

7. The flotation device of claim 6 further comprising an elongated peg fitted and secured within at least one of said peg holes.

8. The flotation device of claim 6 comprising a left handhold component comprising one or more peg holes formed within the left forward portion of the flotation device and a right handhold component comprising one or more peg holes formed within the right forward portion of the flotation device.

9. The flotation device of claim 1 wherein said handhold component comprises a) one or more elongated void formed within the forward portion of the flotation device, and b) one or more peg holes formed within the forward portion of the flotation device.

10. The flotation device of claim 9 wherein either or both said one or more elongated void and said one or more peg hole is arranged having right and left bilateral symmetry with respect to the forward portion of the flotation device.

11. The flotation device of claim 10 wherein said handhold component comprises a left handhold component comprising handhold component at least two elongated voids positioned proximal each other thereby forming a narrow elongated strip between them and a right handhold component comprising handhold component at least two elongated voids positioned proximal each other thereby forming an elongated strip between them.

12. The flotation device of claim 11 wherein said left handhold component comprises a plurality of peg holes and said right handhold component comprises a plurality of peg holes, each said right and left handhold component having an elongated peg fitted and secured within at least one of said peg holes.

13. The flotation device of claim 1 wherein said buoyant material comprises a foamed polymeric material.

14. The flotation device of claim 1 further comprising a circular hole sized to fit a cup or bottle.

15. A method of facilitating rehabilitation of walking and/or movement ability for a patient suffering from a neuromuscular or movement deficit comprising:

a) placing said patient in a body of water at a water level that is less that or equal to the height of the patient's shoulders and greater than or equal to the height of the patient's waist so that said patient's body is positioned within a void of a flotation device; said flotation device comprising:

i) a substantially flat buoyant material comprising a forward portion, and ii) two side portions having a length and width sufficient for a user to rest the elbow or forearm; said side portions being joined by said forward portion;

each such side portion comprising an interior side edge continuous with the forward portion to at least partially define said void, and wherein the flotation device further comprises a handhold component selected from the group consisting of: one or more elongated void formed within the flotation device, and one or more peg holes formed within the flotation device, and b) causing said patient to walk, and/or exercise at least one extremity in said body of water while resting at least one forearm on a side portion of said flotation device.

16. The method of claim 15 wherein the patient maintains contact with said flotation device by grasping said one or more handhold component.

17. The method of claim 15 wherein said one or more handhold component comprises a peg fixed within at least one peg hole formed within the forward portion of the flotation device.

18. The method of claim 15 wherein said one or more handhold component comprises one or more elongated void formed within the forward portion.

19. The method of claim 15 further comprising a step of placing buoyant extremity floats on an arm and/or leg of said patient before step b).

20. A flotation device comprising a substantially flat component which comprises a buoyant material, said substantially flat component having a) a forward portion including a first handhold component comprising one or more elongated void defined therein, a second handhold component comprising at least one peg hole defined therein, and an optional cupholder component comprising a substantially circular void defined therein, and b) two side portions having a length and width sufficient for a user to rest the elbow or forearm thereupon;

each such side portion comprising being continuous with the forward portion to define a void sized to be sufficiently large that a person's body may be positioned therewithin.

* * * * *